US005346137A

United States Patent [19]

Okamoto et al.

[11] Patent Number: 5,346,137

[45] Date of Patent: Sep. 13, 1994

[54] ELECTROMAGNETIC FUEL INJECTION VALVE

[75] Inventors: Yoshio Okamoto, Ibaraki; Hisanobu Kanamaru, Katsuta; Hitoshi Maeda, Abiko; Satoshi Suzuki, Katsuta; Tohru Ishikawa, Takahagi; Tokuo Kosuge, Ibaraki; Kiyoshi Amou, Katsuta; Hiroshi Ohki, Tsuchiura; Koji Nakagawa, Matsudo; Yoshiyuki Tanabe; Mizuho Yokoyama, both of Katsuta, all of Japan

[73] Assignee: Hitachi, Ltd., Tokyo, Japan

[21] Appl. No.: 10,396

[22] Filed: Jan. 28, 1993

[30] Foreign Application Priority Data

Jan. 30, 1992 [JP] Japan ..... 4-014727

[51] Int. Cl.[5] ..... F02M 51/00

[52] U.S. Cl. ..... 239/585.4; 239/900; 239/533.12

[58] Field of Search ..... 239/533.12, 400, 422, 239/585.4, 900; 123/472, 470, 432; 251/129.21

[56] References Cited

U.S. PATENT DOCUMENTS 4,925,110 5/1990 Takeda et al. ..... 239/533.12
5,109,823 5/1992 Yokoyama et al. ..... 123/472
5,109,824 5/1992 Okamoto et al. ..... 239/533.12 X
5,156,130 10/1992 Soma ..... 239/533.12 X

FOREIGN PATENT DOCUMENTS 61-152765 9/1986 Japan .

*Primary Examiner*—Andres Kashnikow
*Assistant Examiner*—Kevin Weldon
*Attorney, Agent, or Firm*—Antonelli, Terry, Stout & Kraus

[57] ABSTRACT

An electromagnetic fuel injection valve comprises a valve body, a valve seat which cooperates with the valve body, a fuel injection port disposed downstream of the valve seat, and a dividing device which serves to divide injection fuel injected from the fuel injection port. The dividing device is formed integrally with a member in which the fuel injection port is formed and includes parallel walls substantially parallel to each other with the fuel injection port interposed therebetween and arcuate walls connected to the parallel walls having a diameter larger than that of the fuel injection port. The walls extend from said member in a direction of an axis of the valve. The dividing device has an outer diameter substantially equal to the largest diameter of the valve seat.

27 Claims, 9 Drawing Sheets

ELECTROMAGNETIC FUEL INJECTION VALVE

BACKGROUND OF THE INVENTION

The present invention relates to an electromagnetic fuel injection valve which serves to supply fuel to a multivalve engine in which each cylinder has a plurality of intake valves, and more particularly, to an electromagnetic fuel injection valve which has fuel dividing means disposed downstream of a fuel injection port for dividing the injection fuel.

An electromagnetic fuel injection valve for use in a multivalve engine in which each cylinder thereof has two intake valves is disclosed in U.S. Pat. No. 5,109,824. In this electromagnetic fuel injection valve, a dividing element serving to divide the injected fuel is disposed downstream of an injection port which effects the metering of the injection fuel. The fuel dividing element includes a single fuel passage comprising a small-diameter passage portion and large-diameter passage portions oppositely and equally spaced with respect to the small-diameter passage portion, and is so disposed as to be coaxial with the fuel injection port.

Fuel injected from the fuel injection port is guided by the side walls of the small-diameter passage portion disposed downstream of the injection port to the large-diameter passage portions oppositely and equally spaced with respect to the small-diameter passage portion, so as to be divided into two injection flows.

In the above-described conventional electromagnetic fuel injection valve, in order to divide fuel, equalize the divided fuel amounts and atomize the injection fuel in fine particles with high accuracy, it is necessary to manufacture with high accuracy the fuel dividing element and a part for receiving the fuel dividing element as well as to make the center of the fuel injection hole and the center of the fuel dividing element align with each other with a very accurate concentricity. For this reason, the number of working steps and the number of assembling steps are increased, resulting in that the manufacturing cost is raised.

An object of the present invention is to provide an electromagnetic fuel injection valve which is capable of dividing fuel, equalize the divided fuel amounts and atomizing the injection fuel in fine particles with high accuracy as well as of reducing the manufacturing cost.

SUMMARY OF THE INVENTION

An electromagnetic fuel injection valve according to an aspect of the present invention comprises a valve body, a valve seat which cooperates with the valve body, a fuel injection port disposed downstream of the valve seat, and dividing means which serves to divide injection fuel injected from the fuel injection port, the dividing means being formed integrally with a member in which the fuel injection port is formed and including parallel walls substantially parallel to each other with the fuel injection port interposed therebetween and arcuate walls connected to the parallel walls having a diameter larger than that of the fuel injection port, these walls extending from said member in a direction of an axis of the valve.

The dividing means has an outer diameter substantially equal to the largest diameter of the valve seat.

It is preferred that the electromagnetic fuel injection valve further comprises a fuel swirl element disposed upstream of the valve seat for providing a swirl force to fuel.

The dividing means may further include inclined walls formed between the arcuate walls so as to be inclined outwardly.

The dividing means may further include peripheral walls extending from the ends of the inclined walls in the direction of the axis of the valve and connected to the arcuate walls.

An electromagnetic fuel injection valve according to another aspect of the present invention comprises a valve body, a valve seat which cooperates with the valve body, a fuel injection port disposed downstream of the valve seat, and dividing means which serves to divide injection fuel injected from the fuel injection port, the dividing means being formed integrally with a member in which the fuel injection port is formed and including a single fuel passage which diverges from the fuel injection port toward downstream and has a cross-sectional profile perpendicular to an axis of the valve defined by parallel lines substantially parallel to each other with the fuel injection port interposed therebetween and circular arcs connected to the parallel lines.

The dividing means has an outer diameter substantially equal to the largest diameter of the valve seat.

The electromagnetic fuel injection valve may further comprise a fuel swirl element disposed upstream of the valve seat for providing a swirl force to fuel.

The circular arcs connected to the parallel lines may have a diameter larger than that of the fuel injection port.

According to the present invention, since the injection fuel dividing means is formed integrally with the member in which the fuel injection port is formed, it is possible to maintain the concentricity between the fuel dividing means and the fuel injection port with high accuracy. This makes it possible to divide fuel, equalize the divided fuel amounts and atomize the injection fuel in fine particles with high accuracy. Further, due to the integral forming of the dividing means, it becomes unnecessary to work and assemble with high accuracy the fuel dividing element and the part for receiving the fuel dividing element in order to obtain a very accurate concentricity, thereby making it possible to reduce a manufacturing cost.

DESCRIPTION OF THE PREFERRED EMBODIMENTS

Figure 1:
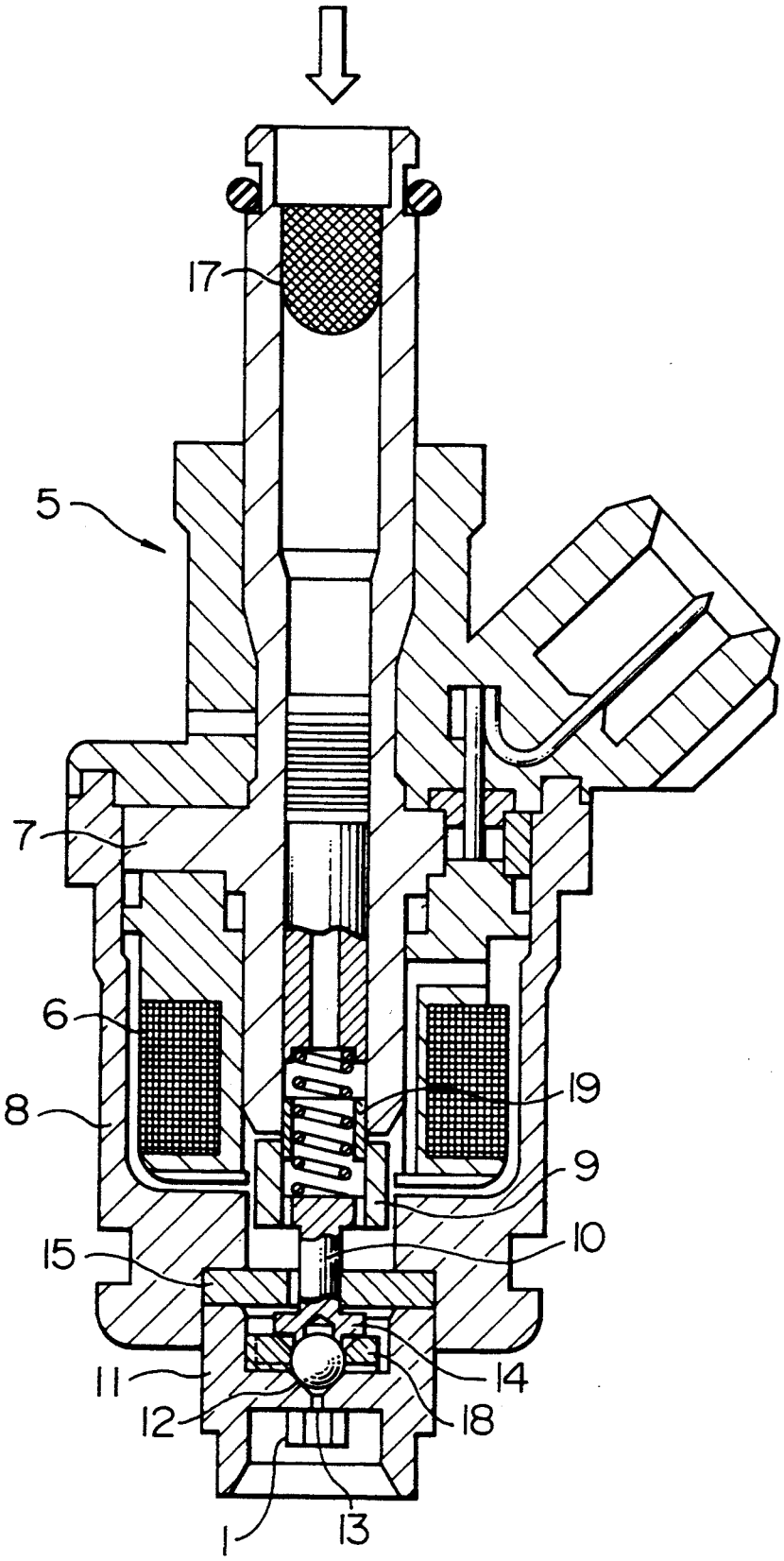
FIG. 1 is a vertical sectional view of a first embodiment of an electromagnetic fuel injection valve according to the present invention.

A first embodiment of the present invention will be explained hereinafter with reference to FIGS. 1 to 10. A fuel injection valve 5 serves to inject and supply fuel by opening and closing the valve in response to ON-OFF signals of a duty calculated by a control unit (not shown). Electric signals are supplied to a coil 6 as pulses. When an electric current is passed through the coil 6, a magnetic circuit is formed by a core 7, a yoke 8 and a plunger 9, and the plunger 9 is attracted to the core 7. As the plunger 9 is moved, a ball valve 10 formed integrally with the plunger 9 is moved so as to be separated from a valve seat 12 of a valve guide 11. As a result, a fuel injection port 13 is opened. The ball valve 10 comprises a rod connected to an end of the plunger 9 made of a magnetic material, a ball which is welded to the other end of the rod, and a guide ring 19 made of a non-magnetic material and secured to an upper opening portion of the plunger 9. When the thus-formed ball valve 10 is moved, it is guided by both the guide ring 19 and an inner surface of a cylindrical fuel swirl element 18 inserted into and fixed to an inner wall of a hollow portion of the valve guide 11. An amount of stroke of the ball valve 10 is determined by a clearance between a receiving surface 14 in a neck portion of the ball valve 10 and a stopper 15.

Figure 2:
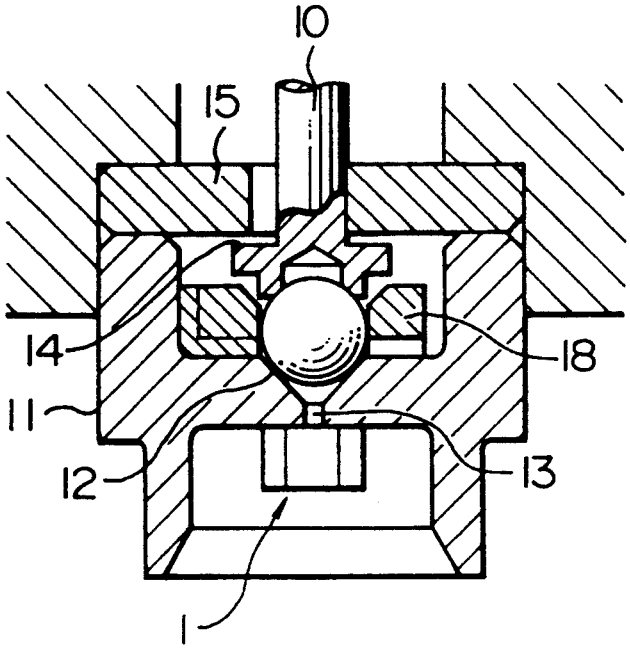
FIG. 2 is an enlarged vertical sectional view of a valve portion.
Figure 3:
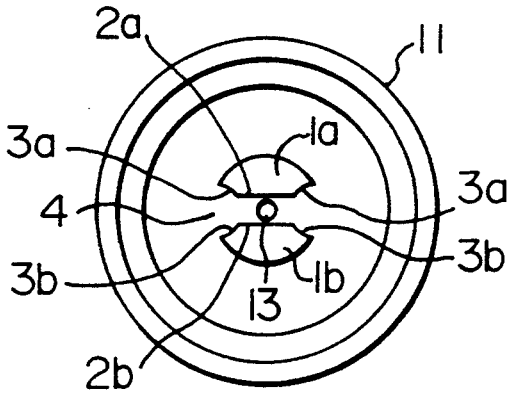
FIG. 3 is an enlarged bottom view of the valve portion.

On the other hand, a fuel dividing portion 1 is so formed as to project from a surface of the valve guide 11 opposite to the valve seat 12. Referring to FIGS. 2 and 3, the dividing portion 1 is formed integrally with the valve guide 11 having the fuel injection port 13 so as to have two projections 1*a*, 1*b* which are extended to the downstream side of the fuel injection port 13 by a suitable length. Further, as shown in FIG. 3, the dividing portion 1 includes a fuel passage 4 defined by arcuate walls 3*a*, 3*b* each determined by a circular arc having a diameter larger than that of the fuel injection port 13 and arranged symmetrically with respect to an axis of the valve and parallel walls 2*a*, 2*b* formed substantially in parallel to each other leaving a space slightly larger than the diameter of the fuel injection port 13 therebetween.

Figure 4:
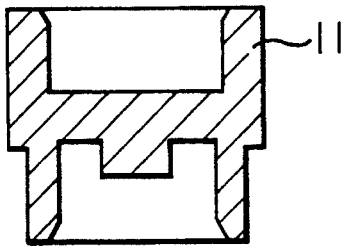
FIGS. 4 and 5 are vertical sectional views of a valve guide in the stages of work for forming integrally a fuel injection port and a dividing means.
Figure 5:
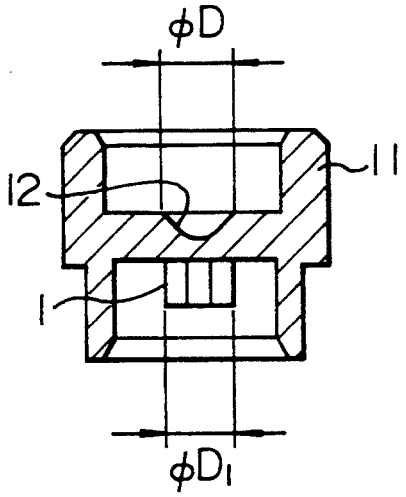

The process of working for forming the valve seat 12, the fuel injection port 13 and the fuel dividing portion 1 into a unit structure now will be described with reference to FIGS. 4 and 5.

The external form of the valve guide 11 is shaped through two stages of cold forging work. FIG. 4 shows the valve guide 11 in the state after being shaped through the two stages of cold forging work. Then, after machining both end surfaces, the valve seat 12 is formed by press forming (plastic deformation). At the same time, the fuel passage 4 of the dividing portion 1 is formed by press forming as well. FIG. 5 shows the valve guide 11 in the state after being shaped by the press forming. Namely, since the valve seat 12 and the dividing portion 1 are formed at the same stage of work, they can be formed coaxially with each other with very high accuracy. In this press forming, the largest diameter $\phi D$ of the valve seat 12 shown in FIG. 5 is so designed as to be substantially equal to an outermost diameter $\phi D1$ of the dividing portion 1. Subsequently, the fuel injection port 13 is formed by punching so as to be coaxial with the valve seat 12 and the dividing portion 1 by making use of the inner peripheral surface of the valve guide.

Fuel flow in the thus-formed electromagnetic fuel injection valve according to the present invention will be described hereinafter. The swirled injection fuel injected from the injection port 13 is first constrained by the parallel walls 2*a*, 2*b* in the dividing portion 1 and guided along the parallel walls 2*a*, 2*b* toward the arcuate walls 3*a*, 3*b*. The guided fuel is led along the arcuate walls 3*a*, 3*b* connected to the parallel walls 2*a*, 2*b* so as to be introduced into a space defined by the arcuate walls 3*a*, 3*b*. By so doing, the injected fuel is divided into two directions effectively. In this way, the swirled fuel from the fuel injection port 13 can be divided efficiently by the dividing portion 1 without losing the swirl energy, and furthermore, since joining or combining of fuel particles is prevented, it becomes possible to form the atomized fuel of good atomization condition.

Figure 6:
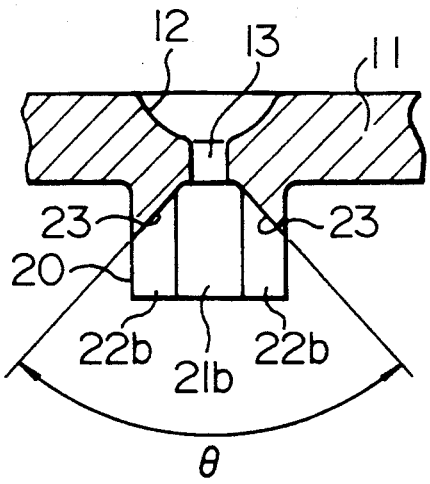
FIG. 6 is an enlarged vertical sectional view of a modification of the valve portion of the first embodiment.
Figure 8:
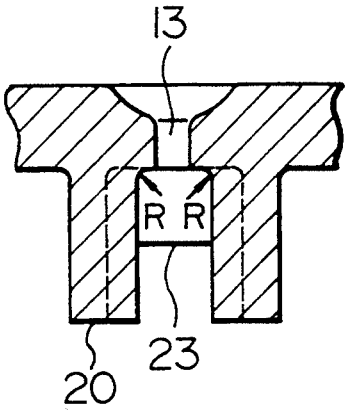
FIG. 8 is an enlarged vertical sectional view of the modified valve portion as viewed from a direction perpendicular to that of FIG. 6.
Figure 7:
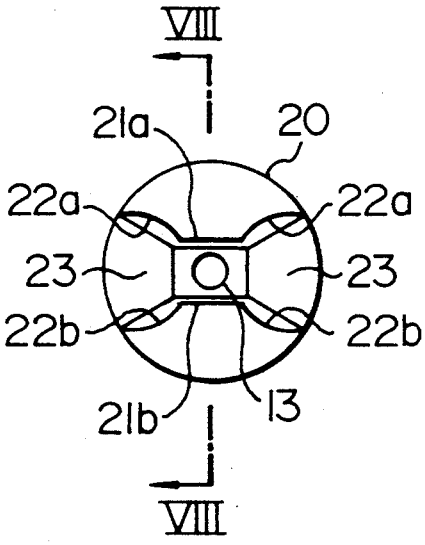
FIG. 7 is a bottom view of the modified valve portion.

Next, a modification of the above-described embodiment will be described with reference to FIGS. 6 to 8. Between arcuate walls 22*a*, 22*b* of a dividing portion 20 are formed inclined walls 23 which are inclined from the fuel injection port 13 at a divergence angle $\theta$. The inclined walls 23 have a function of improving the flowability of the material at the time of the press forming so as to avoid the concentration of working strain and working stress as well as to make it easy to remove the mold. In result, the productivity can be further improved.

The swirled injection fuel injected from the injection port 13 is first constrained by parallel walls 21*a*, 21*b* in the dividing portion 20 and guided along the parallel walls 21*a*, 21*b* toward the arcuate walls 22*a*, 22*b*. The guided fuel is led along the arcuate walls 22*a*, 22*b* connected to the parallel walls 21*a*, 21*b* so as to be introduced into a space defined by the arcuate walls 22*a*, 22*b*. Thus, the injected fuel is divided into two directions effectively.

In this modification as well, the same fuel dividing effect as that of the above embodiment can be obtained. Incidentally, it is preferred that the wall 23 and the fuel injection port 13 are connected by a wall having such a radius R of curvature that can prevent them from interfering with each other.

Figure 9:
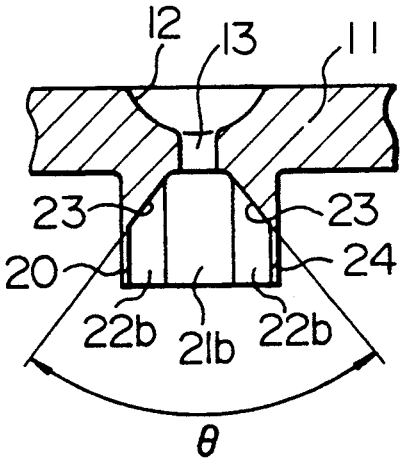
FIG. 9 is an enlarged vertical sectional view of a further modification of the valve portion.
Figure 10:
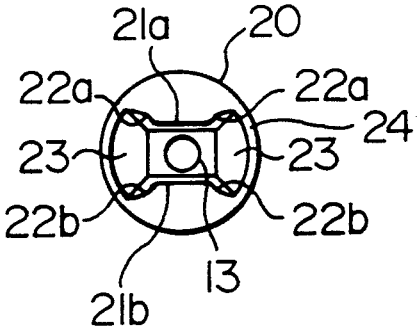
FIG. 10 is a bottom view of the further modified valve portion.

FIGS. 9 and 10 show a further modification. In the further modification, the dividing portion 20 is formed at the ends of the inclined walls 23 with peripheral walls 24 which are connected to the arcuate walls 22*a*, 22*b*. These walls 24 have a function of preventing the swirled injection fuel injected from the fuel injection port 13 from being drawn up to the outer periphery of the dividing portion 20. By so doing, any dispersing of the fuel can be restrained so that the swirled fuel can be divided more effectively as compared with the above-described embodiment.

Figure 11:
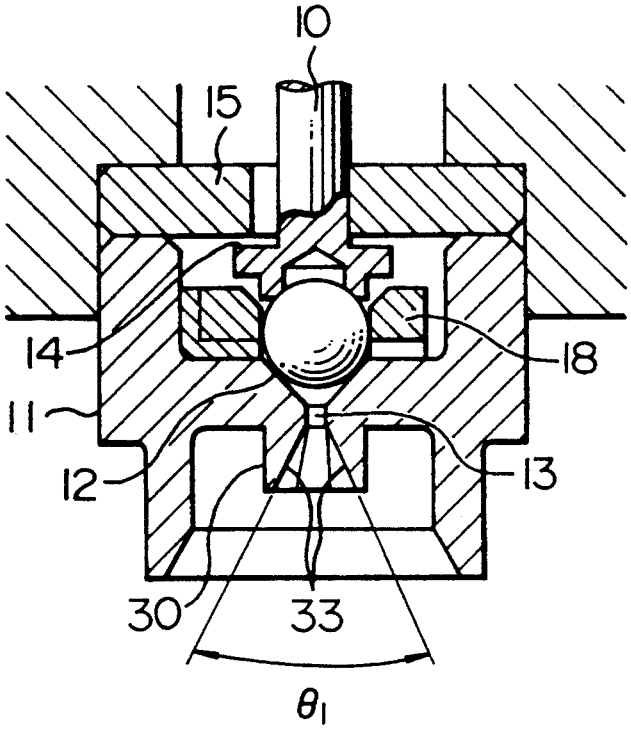
FIG. 11 is an enlarged vertical sectional view of a valve portion of a second embodiment of an electromagnetic fuel injection valve according to the present invention.
Figure 12:
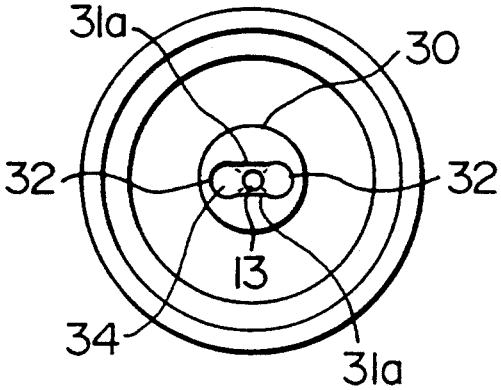
FIG. 12 is a bottom view of the valve portion of FIG. 11.

A second embodiment of the present invention will be described with reference to FIGS. 11 and 12. In this embodiment, a dividing portion 30 is formed integrally with the valve guide 11 and has a single fuel passage 34 which diverges from the fuel injection port 13 in the downstream direction. The fuel passage 34 has a cross-sectional profile which is perpendicular to the axis of the valve and is defined by parallel lines 31*a* substantially parallel to each other with the fuel injection port 13 interposed therebetween and circular arcs 32 connected to the parallel lines 31*a* and having a diameter larger than that of the fuel injection port 13.

The present embodiment has an advantage facilitating the removal of molds upon press forming in addition to the advantages of the first embodiment.

Figure 13:
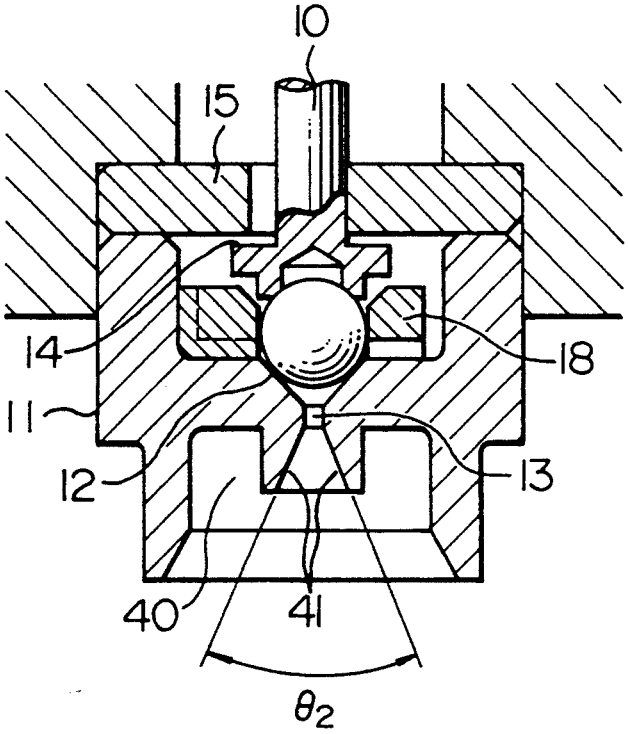
FIG. 13 is an enlarged vertical sectional view of a modification of the valve portion of the second embodiment.
Figure 14:
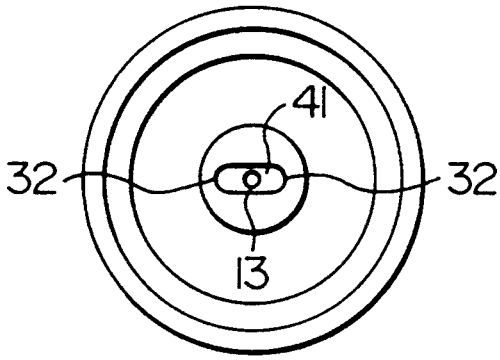
FIG. 14 is a bottom view of the modified valve portion.

FIGS. 13 and 14 show a modification of the second embodiment. In this modification, the diameter of the circular arcs forming the fuel passage of the dividing portion is so selected as to be substantially equal to the distance between the parallel lines 31*a*.

In this modification, since the diameter of the circular arc connected to the parallel lines is substantially equal to the distance between the parallel lines and since there is no circular arc having a larger diameter than that, the injection fuel dividing function is deteriorated as compared with the above-described embodiments. However, the structure of the mold used in the press forming of the valve guide can be simplified, so that the lifetime of the mold can be prolonged.

Next, a third embodiment of an electromagnetic fuel injection valve according to the present invention will be described with reference to FIG. 15. In the above-described embodiments, the valve body has been described as being a ball valve and the fuel swirl element 18 was used in each case, however, in the third embodiment, what is called a pintle valve is used as the valve body and no fuel swirl element is used. The dividing portion 1 of the first embodiment is disposed downstream of the fuel injection port 13 and, like the above-described embodiments, the dividing portion 1 is formed integrally with the valve guide 11 in which the valve seat 12 and the fuel injection port 13 are formed.

Figure 16:
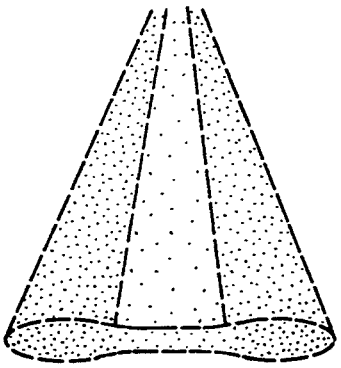
FIG. 16 is a schematic perspective view showing the divided state of injection fuel obtained according to the third embodiment.

When a pintle valve 50 is moved upward to open the valve, fuel is injected from the fuel injection port 13 in the form of a hollow cone. The injection fuel is confined from both sides thereof by the parallel walls 2*a*, 2*b* (see FIG. 3). As a result, the injection fuel is roughly divided into two flows as shown in FIG. 16. In this third embodiment, the fuel dividing function is deteriorated as compared with the above-described embodiments having the fuel swirl element; however, it is possible to provide a practically sufficient fuel dividing function for a certain kind of engine.

Figure 15:
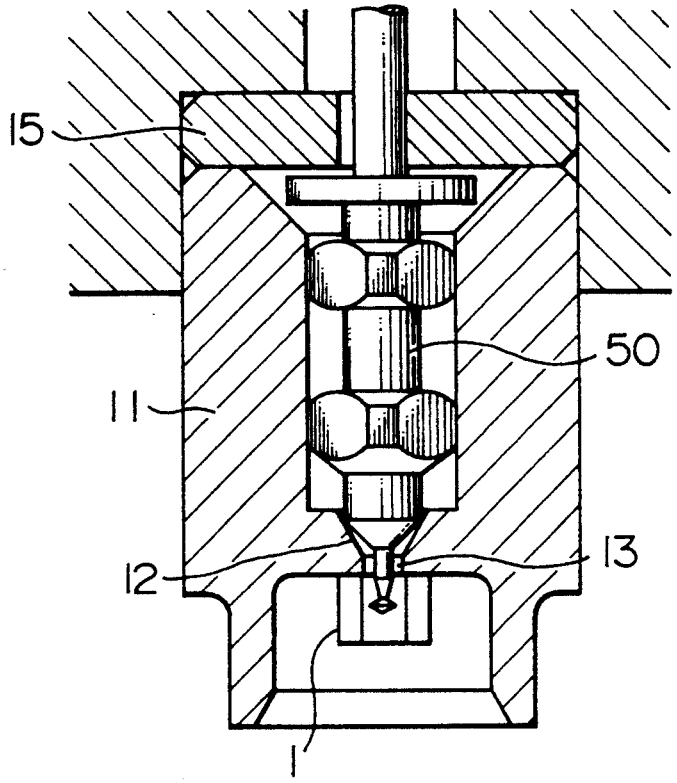
FIG. 15 is an enlarged vertical sectional view of a valve portion of a third embodiment of an electromagnetic fuel injection valve according to the present invention.

Further, the dividing portion 1 of the first embodiment is shown in FIG. 15; however, it goes without saying that the dividing portions of the above described embodiments including the modifications can be used.

Next, an engine control system on which the electromagnetic fuel injection valve 5 according to the present invention is mounted will be explained with reference to FIGS. 17 and 18. A DOHC (Double Over Head Camshaft) engine comprises two cam shafts for driving intake and exhaust valves so as to easily provided an engine of high revolution and high power. In particular, in four valve engines, an excellent performance can be obtained since ignition can be conducted in the vicinity of the central portion of the combustion chamber. Furthermore, since a great amount of air can be suctioned into the engine at a time, a significantly high response can be realized. The DOHC engines have a lot of merits as explained above.

Figure 17:
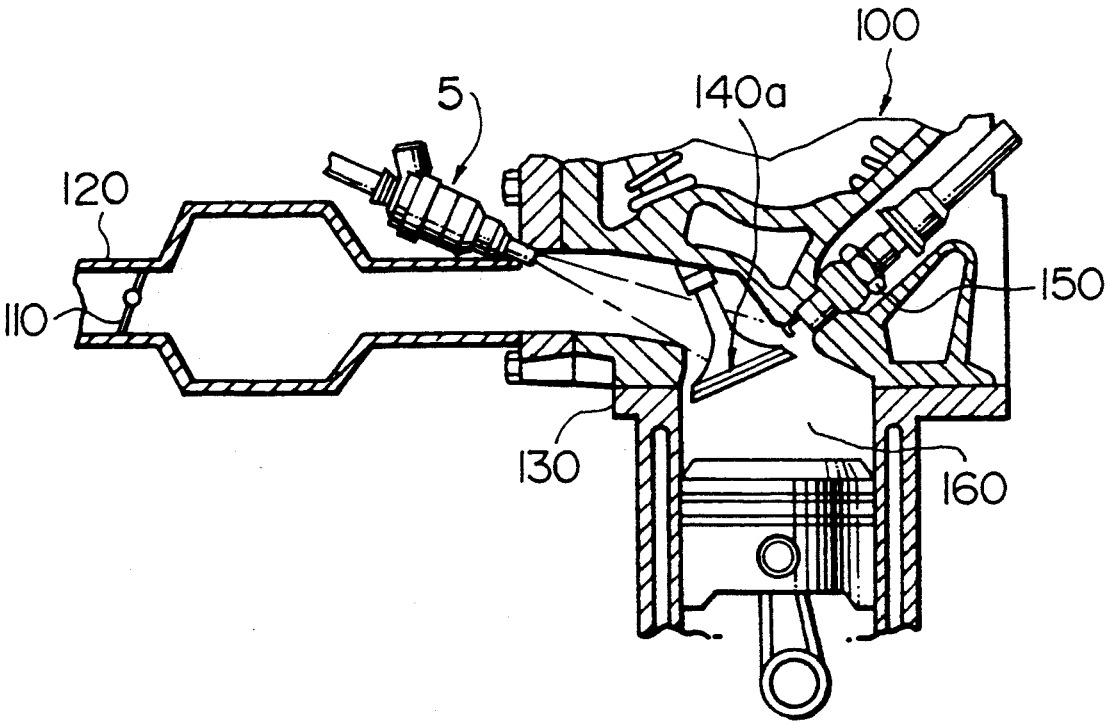
FIG. 17 is a schematic vertical sectional view of an engine in which an electromagnetic fuel injection valve according to the present invention is employed.

FIG. 17 is a sectional view showing a portion of a DOHC engine 100 which uses gasoline as fuel. As shown in FIG. 17, the DOHC engine 100 comprises an intake manifold 120 having a throttle valve 110 disposed therein, air intake ports 130, air intake valves 140 for opening and closing the air intake ports 130, an ignition plug 150 one end of which is exposed to a combustion chamber 160, and the fuel injection valve 5 fixed to the wall portion of the intake manifold 120 in a position upstream of the air intake valves 140 so that the fuel can be injected toward valve seats 140*a* of the air intake valves 140.

Figure 18:
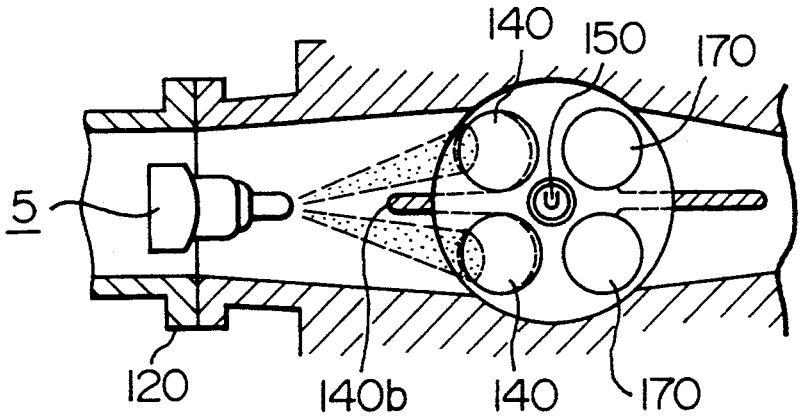
FIG. 18 is a schematic cross sectional view showing a positional relationship between the electromagnetic fuel injection valve according to the present invention and air intake valves.

Further, FIG. 18 shows a positional relation between the fuel injection valve 5 and the air intake valves 140. The fuel atomized from the injection valve 5 is divided into two directions so as not to collide against a partition wall 140*b* formed between the air intake valves 140. Incidentally, reference numeral 170 denotes exhaust valves.

As described above, by using the electromagnetic fuel injection valve according to the present invention, the fuel can be distributed uniformly so that the combustion performance can be improved, thereby making it possible to provide a high-performance engine.

What is claimed is:

1. An electromagnetic fuel injection valve comprising:

a valve body;

a valve seat which cooperates with said valve body;

a fuel injection port disposed downstream of said valve seat; and dividing means for dividing injection fuel injected from said fuel injection port, said dividing means being formed as a single element with a member in which said fuel injection port is formed and including parallel walls substantially parallel to each other with said fuel injection port interposed therebetween and arcuate walls connected to said parallel walls having a diameter larger than that of said fuel injection port, said walls extending from said member in a direction of an axis of the valve.

2. An electromagnetic fuel injection valve according to claim 1, wherein said dividing means has an outer diameter substantially equal to the largest diameter of said valve seat.

3. An electromagnetic fuel injection valve according to claim 2, further comprising a fuel swirl element disposed upstream of said valve seat for providing a swirl force to fuel.

4. An electromagnetic fuel injection valve according to claim 2, wherein said dividing means further includes inclined walls formed between said arcuate walls so as to be inclined outwardly.

5. An electromagnetic fuel injection valve according to claim 1, wherein said dividing means further includes inclined walls formed between said arcuate walls so as to be inclined outwardly.

6. An electromagnetic fuel injection valve according to claim 1, further comprising a fuel swirl element disposed upstream of said valve seat for providing a swirl force to fuel.

7. An electromagnetic fuel injection valve comprising:

a valve body;

a valve seat which cooperates with said valve body;

a fuel injection port disposed downstream of said valve seat;

dividing means for dividing injection fuel injected from said fuel injection port, said dividing means being formed integrally with a member in which said fuel injection port is formed and including parallel walls substantially parallel to each other with said fuel injection port interposed therebetween and arcuate walls connected to said parallel walls having a diameter larger than that of said fuel injection port, said walls extending from said member in a direction of an axis of the valve; and a fuel swirl element disposed upstream of said valve seat for providing a swirl force to fuel;

wherein said dividing means further includes inclined walls formed between said arcuate walls so as to be inclined outwardly.

8. An electromagnetic fuel injection valve according to claim 7, wherein said dividing means further includes peripheral walls extending from ends of said inclined walls in a direction of an axis of the valve so as to be connected to said arcuate walls.

9. An electromagnetic fuel injection valve comprising:

a valve body;

a valve seat which cooperates with said valve body;

a fuel injection port disposed downstream of said valve seat;

dividing means for dividing injection fuel injected from said fuel injection port, said dividing means being formed integrally with a member in which said fuel injection port is formed and including parallel walls substantially parallel to each other with said fuel injection port interposed therebetween and arcuate walls connected to said parallel walls having a diameter larger than that of said fuel injection port, said walls extending from said member in a direction of an axis of the valve;

wherein said dividing means has an outer diameter substantially equal to the largest diameter of said valve seat; and a fuel swirl element disposed upstream of said valve seat for providing a swirl force to fuel;

wherein said dividing means further includes inclined walls formed between said arcuate walls so as to be inclined outwardly.

10. An electromagnetic fuel injection valve according to claim 9, wherein said dividing means further includes peripheral walls extending from ends of said inclined walls in a direction of an axis of the valve so as to be connected to said arcuate walls.

11. An electromagnetic fuel injection valve comprising:

a valve body;

a valve seat which cooperates with said valve body;

a fuel injection port disposed downstream of said valve seat;

dividing means for dividing injection fuel injected from said fuel injection port, said dividing means being formed integrally with a member in which said fuel injection port is formed and including parallel walls substantially parallel to each other with said fuel injection port interposed therebetween and arcuate walls connected to said parallel walls having a diameter larger than that of said fuel injection port, said walls extending from said member in a direction of an axis of the valve;

wherein said dividing means further includes inclined walls formed between said arcuate walls so as to be inclined outwardly;

wherein said dividing means further includes peripheral walls extending from ends of said inclined walls in a direction of an axis of the valve so as to be connected to said arcuate walls.

12. An electromagnetic fuel injection valve comprising:

a valve body;

a valve seat which cooperates with said valve body;

a fuel injection port disposed downstream of said valve seat;

dividing means for dividing injection fuel injected from said fuel injection port, said dividing means being formed integrally with a member in which said fuel injection port is formed and including parallel walls substantially parallel to each other with said fuel injection port interposed therebetween and arcuate walls connected to said parallel walls having a diameter larger than that of said fuel injection port, said walls extending from said member in a direction of an axis of the valve;

wherein said dividing means has an outer diameter substantially equal to the largest diameter of said valve seat;

wherein said dividing means further includes inclined walls formed between said arcuate walls so as to be inclined outwardly;

wherein said dividing means further includes peripheral walls extending from ends of said inclined walls in a direction of an axis of the valve so as to be connected to said arcuate walls.

13. An electromagnetic fuel injection valve comprising:

a valve body;

a valve seat which cooperates with said valve body;

a fuel injection port disposed downstream of said valve seat; and dividing means for dividing injection fuel injected from said fuel injection port, said dividing means being formed as a single element with a member in which said fuel injection port is formed and including a single fuel passage which diverges from said fuel injection port toward downstream and has a cross-sectional profile perpendicular to an axis of the valve and defined by parallel lines substantially parallel to each other with said fuel injection port interposed therebetween and circular arcs connected to said parallel lines.

14. An electromagnetic fuel injection valve according to claim 13, wherein said dividing means has an outer diameter substantially equal to the largest diameter of said valve seat.

15. An electromagnetic fuel injection valve according to claim 14, wherein said circular arcs connected to said parallel lines each have a diameter larger than that of said fuel injection hole.

16. An electromagnetic fuel injection valve according to claim 13, wherein said circular arcs connected to said parallel lines each have a diameter larger than that of said fuel injection hole.

17. An electromagnetic fuel injection valve according to claim 13, further comprising a fuel swirl element disposed upstream of said valve seat for providing a swirl force to fuel.

18. An electromagnetic fuel injection valve according to claim 17, wherein said circular arcs connected to said parallel lines each have a diameter larger than that of said fuel injection hole.

19. A multivalve engine comprising:

an electromagnetic fuel injection valve which comprises a valve body, a valve seat which cooperates with said valve body, a fuel injection port disposed downstream of said valve seat, and dividing means for dividing injection fuel injected from said fuel injection port, said dividing means being formed as a single element with a member in which said fuel injection port is formed and including parallel walls substantially parallel to each other with said fuel injection port interposed therebetween and arcuate walls connected to said parallel walls having a diameter larger than that of said fuel injection port, said walls extending from said member in a direction of an axis of the valve; and air intake valves disposed downstream of said electromagnetic fuel injection valve, wherein an angle of the fuel injection from said electromagnetic fuel injection valve is arranged so that fuel is injected within intake ports of said multivalve engine.

20. A multivalve engine according to claim 19, wherein said dividing means has an outer diameter substantially equal to the largest diameter of said valve seat.

21. An electromagnetic fuel injection valve comprising: a valve body; and a valve guide having a valve seat formed therein which cooperates with said valve body; a fuel injection port disposed in said valve guide downstream of said valve seat; and dividing means for dividing injection fuel injected from said fuel injection port, said dividing means comprising a projecting member formed as a single element with said valve guide in axial alignment with said fuel injection port so as to project from a surface of said valve guide which contains said fuel injection port, said projecting member including parallel walls substantially parallel to each other with said fuel injection port interposed therebetween and arcuate walls extending on either side of each of said parallel walls and having a diameter larger than that of said fuel injection port.

22. An electromagnetic fuel injection valve according to claim 21, wherein said projecting member has an outer diameter substantially equal to the largest diameter of said valve seat.

23. An electromagnetic fuel injection valve according to claim 21, wherein said dividing means further includes inclined walls formed between said arcuate walls so as to be inclined outwardly.

24. An electromagnetic fuel injection valve according to claim 21, wherein said dividing means further includes peripheral walls extending from ends of said inclined walls in a direction of an axis of the valve so as to be connected to said arcuate walls.

25. An electromagnetic fuel injection valve comprising: a valve body; and a valve guide having a valve seat formed therein which cooperates with said valve body; a fuel injection port disposed in said valve guide downstream of said valve seat; and dividing means for dividing injection fuel injected from said fuel injection port, said dividing means comprising a member formed as a single element with said valve guide in axial alignment with said fuel injection port so as to project from a surface of said valve guide which contains said fuel injection port, said member including a single fuel passage which diverges from said fuel injection port in the downstream direction of fuel flow and has a cross-sectional profile perpendicular to the axis of said fuel injection port which is defined by first and second lines substantially parallel to each other with said fuel injection port interposed therebetween and circular arcs connected to both ends of said parallel lines.

26. An electromagnetic fuel injection valve according to claim 25, wherein said dividing means has an outer diameter substantially equal to the largest diameter of said valve seat.

27. An electromagnetic fuel injection valve according to claim 25, wherein said circular arcs connected to said parallel lines each have a diameter larger than that of said fuel injection port.

* * * * *